US005276926A

United States Patent [19]

Lopez

[11] Patent Number: 5,276,926

[45] Date of Patent: Jan. 11, 1994

[54] BABY BATH AND SEAT

[76] Inventor: Raquel Lopez, 1230 Yosemite Dr., Los Angeles, Calif. 90041

[21] Appl. No.: 924,857

[22] Filed: Aug. 4, 1992

[51] Int. Cl.[5] ..... A47K 3/024; A47K 3/20

[52] U.S. Cl. ..... 4/568; 4/575.1; 4/579; 4/572.1

[58] Field of Search ..... 4/516, 517, 518, 520, 4/521, 522, 523, 567, 568, 570, 571.1, 572.1, 573.1, 574.1, 575.1, 578.1, 579, 659

[56] References Cited

U.S. PATENT DOCUMENTS

| | | | |
|---|---|---|---|
| 717,148 | 12/1902 | Walters | 4/522 |
| 1,062,704 | 5/1913 | Greenwood | 4/659 |
| 2,193,374 | 3/1940 | Notter | 4/572.1 |
| 2,460,308 | 2/1949 | Pribil | 4/572.1 |
| 2,531,724 | 11/1950 | Cevasco | 4/572.1 |
| 2,697,480 | 12/1954 | DuBois et al. | 4/572.1 |
| 2,724,839 | 11/1955 | Kennedy | 4/572.1 |
| 2,751,603 | 6/1956 | Brinkman | 4/572.1 |
| 2,760,208 | 8/1956 | Mussells | 4/572.1 |
| 3,040,335 | 6/1962 | Gellmann | 4/579 |
| 3,711,152 | 1/1973 | Sirpak et al. | 297/423 X |
| 3,882,553 | 5/1975 | Poiencot | 4/565.1 |
| 4,316,294 | 2/1982 | Baldwin | 4/575.1 |
| 4,651,361 | 3/1987 | Nolan | 4/516 |
| 4,719,653 | 1/1988 | Bishop et al. | 4/572.1 |
| 4,754,503 | 7/1988 | Martin | 4/523 X |
| 4,881,281 | 11/1989 | Lavoine et al. | 4/572.1 |
| 4,951,329 | 8/1990 | Shaw | 4/568 |

FOREIGN PATENT DOCUMENTS

| | | | |
|---|---|---|---|
| 0097249 | 5/1988 | Fed. Rep. of Germany | 4/575.1 |
| 0694492 | 7/1953 | United Kingdom | 4/521 |
| 0980122 | 1/1965 | United Kingdom | 4/568 |

OTHER PUBLICATIONS

Century Products Catalog ® 1992 pp. 63, 64 (no effective date given).

*Primary Examiner*—Henry J. Recla
*Assistant Examiner*—Robert M. Fetsuga
*Attorney, Agent, or Firm*—Michael J. Ram

[57] ABSTRACT

A bathenette seat for bathing a baby is provided where the seat has a headrest with an opening which is sized and shaped to accept the back of the head of the baby being bathed so as to allow the washing of the back of the baby's head without allowing soap to get into the baby's eyes or ears. The bathenette further includes a leg support spaced from the headrest and a sprayer located on the leg support. The sprayer is positioned to spray water on the baby reclining in the seat. The bathenette also includes a height adjustment mechanism to vary the position of the headrest and a band around the opening of the headrest to further support the baby's head.

15 Claims, 3 Drawing Sheets

FIG. 1
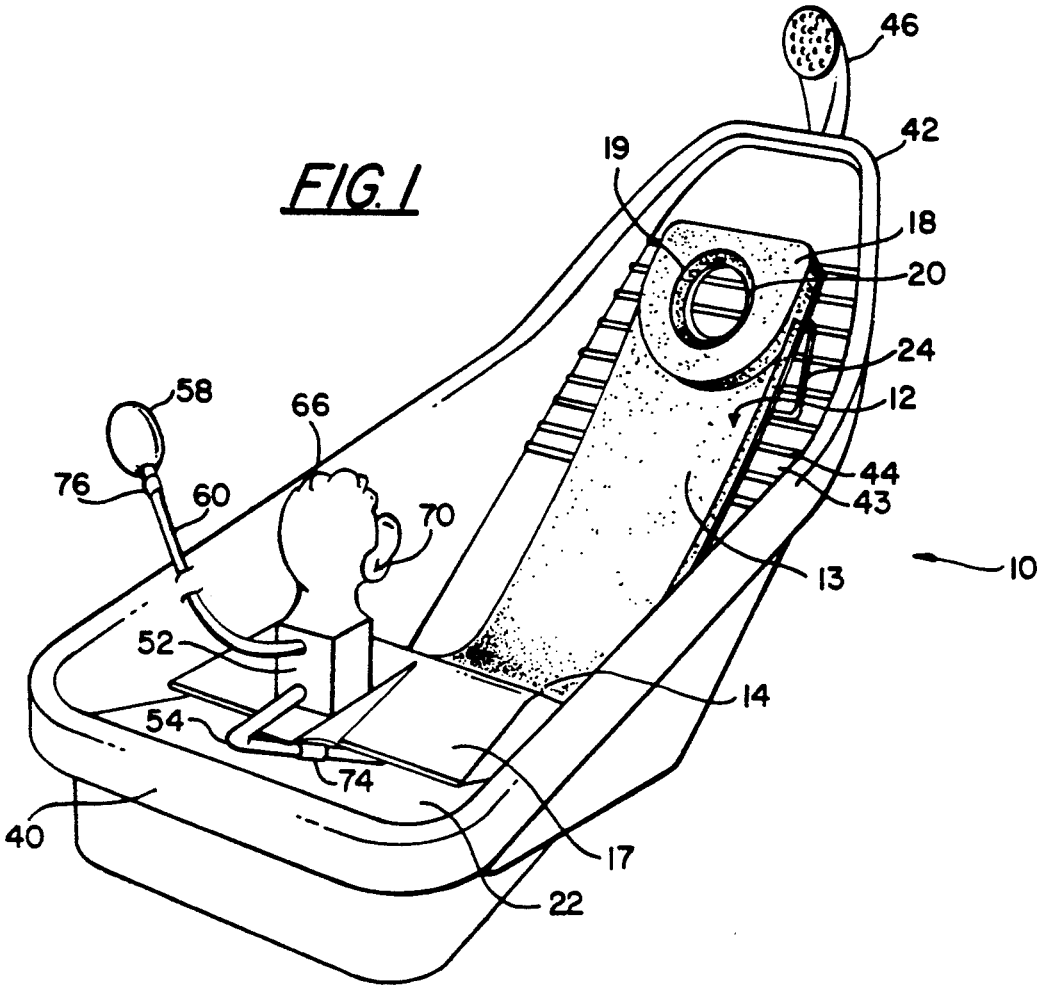
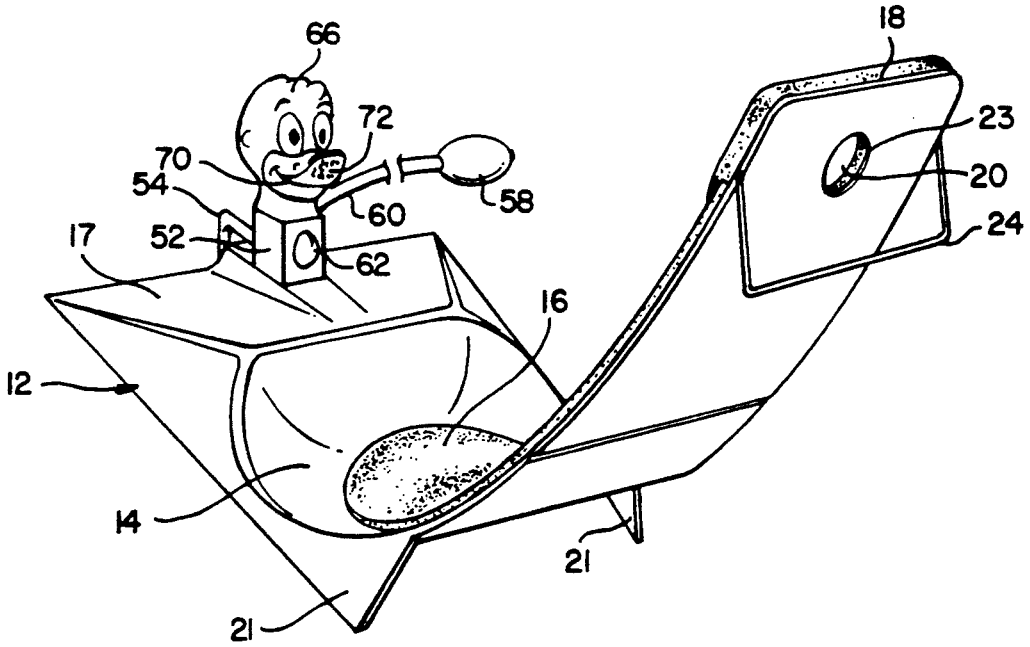
FIG. 2

BABY BATH AND SEAT

BACKGROUND

The present invention relates to a baby bathenette seat for supporting an infant during bathing.

Bathenettes are well-known for washing infants. It is also well-known to employ a seat within the bathenette to support the baby and help keep the baby from accidentally becoming emersed in the bath water.

Even with the use of such a seat, however, it is difficult to wash the baby's hair while keeping soap and water out of the infant's eyes and ears.

Apparatus to assist in washing the hair of a prone adult are known. However, these devices generally utilize a support placed behind the neck with the head being suspended over an open reservoir. Such a design is wholly unsuitable for use with an infant as the infant's head should be supported at all times to prevent injury.

Thus, there is a need for a simple, safe and inexpensive bathenette seat which will facilitate the washing of an infant's hair while protecting the baby's ears from emersion in water and the baby's eyes from damage from harsh soaps or shampoos.

SUMMARY

These needs are met by the bathenette seat of the present invention.

The bathenette seat of the invention comprises a support structure adapted to receive an infant during bathing procedures. The seat further comprises a headrest positioned to support the infant's head. The headrest has an opening which is sized to receive and surround the infant's head, thereby allowing an adult to wash at least the back of the infant's head without allowing soap and water to run into the infant's face and ears.

DRAWINGS

These and other features, aspects, and advantages of the present invention will become better understood with reference to the following description, appended claims, and accompanying drawings, where:

FIG. 1 is a perspective view of a tub and seat having features of the invention.

FIG. 2 is a second perspective view of the seat of FIG. 1 viewed from a second angle.

DESCRIPTION

Figure 3:
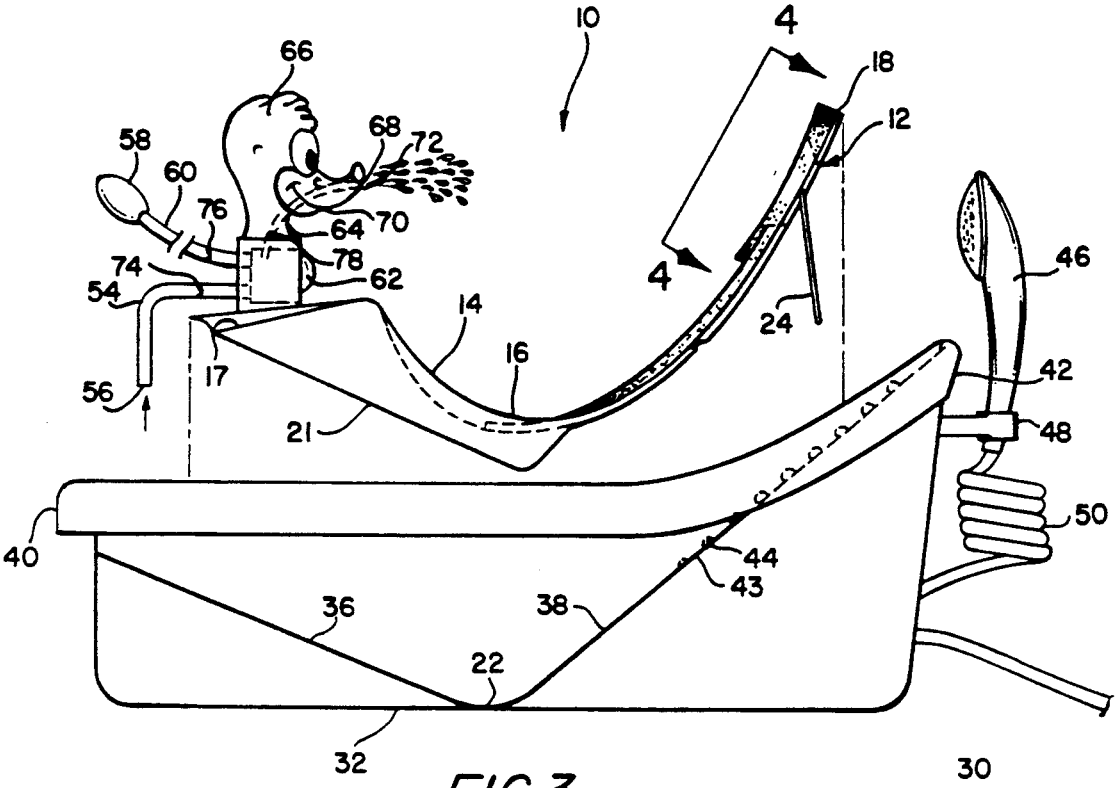
FIG. 3 is an exploded side view of the tub and seat of FIG. 1, partially cut away to show the placement of the seat in the tub.
Figure 4:
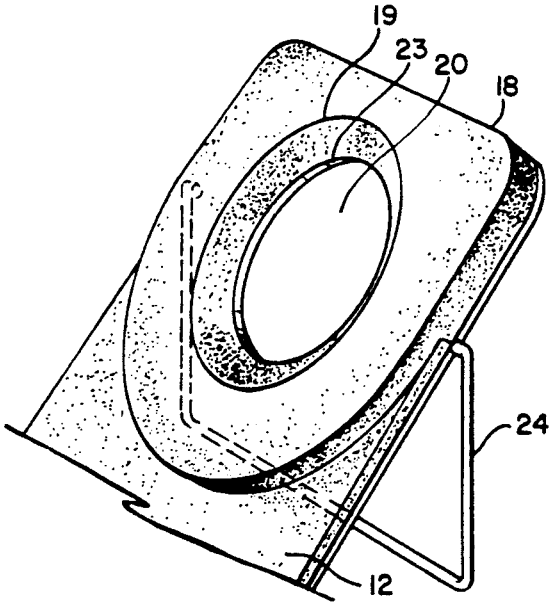
FIG. 4 is an enlarged perspective view of the head portion of the seat shown in FIG. 1 as viewed along reference line 4—4 of FIG. 3.

FIGS. 1 through 4 show a preferred version of the bathenette 10 embodying features of the invention. Bathenette 10 comprises a baby seat 12 and a tub 30.

The baby seat 12 comprises a lower, cradle portion 14 shaped to receive the lower torso of the baby, the cradle preferably including a depression 16 for receiving the infant's buttocks and a leg support section 17.

The baby seat 12 further comprises a headrest 18 with an opening 20 formed therein. The opening 20 is sized and dimensioned to surround and support the head of an infant placed thereon with a portion of the infant's head being exposed through the opening. Preferably, the uppermost one-half of the periphery of the opening approximates the size of the baby's head so that it receives and holds the head during washing.

The bathenette seat 12 is preferably composed of a lightweight plastic material such as polyethylene, polypropylene or other similar structural plastic. The headrest 18 is preferably composed of and the supporting surface 13 of the seat 12 is preferably covered with a soft cushioning material, such as a foam rubber, the opening 20 tapering in a funnel shape, to match the spherical shape of a baby's head, from a larger diameter 19 at the surface of the headrest 18 to a smaller diameter 23 at the back surface of the headrest 18. As an alternate the soft cushioning material on the headrest 18 and the supporting surface 13 can be composed of a vinyl mesh filled with particulate polystyrene material.

The seat 12 has supporting means under the cradle portion 14, such as feet 21, shaped to match the contour of the inner surface 22 of the tub 30.

The headrest 18 can be adjusted up or down by an adjustable headrest bar 24.

The tub 30 is preferably sized to be both portable and to adequately hold an infant. Since it will normally be placed on a horizontal surface, the tub 30 can be formed with a flat bottom 32. Alternatively, the interior surface of the tub 30 can be sloped and the seat 12 support means can be appropriately shaped to cooperate in producing the desired positioning of the baby in the tub 30. As best shown in FIG. 3, the inner surface 22 of the tub 30 has first and second surfaces 36 and 38 rising at an angle from the bottom 32 toward the foot 40 and the head 42 of the tub 30, respectively. To aid in the positioning the headrest 24, the upper face of the second surface 38 has means therein such as lateral grooves 43 or raised ridges 44 which cooperate with the headrest bar 24 to properly position the height of the headrest 18. The feet 21 of the seat 12 are shaped to match the first surface 36 when the headrest bar 24 is properly located against the ridge 44.

A further embodiment comprises the seat 12 permanently attached to the tub 30, for example, by molding as a single unit. This eliminates the possibility of the seat 12 being accidentally repositioned while bathing the infant.

Additionally, the tub 30 and/or seat 12 may have means attached thereto for spraying water on the infant or which can function to entertain or distract the infant during bathing. For example, the bathenette 10 has a shower head 46 removably attached to a holder 48 secured to the head end 42 of the tub 30. Attached to the shower head 46 is a hose 50 which can be connected to any convenient source of water. Attached to the cradle 14, preferably in the middle of the leg support 17 is a sprayer 52. The sprayer 52 may have a hose connected to a water source or, as shown in the Figures, a suction tube 54 with the intake end 56 immersed in the water in the tub 30. Operatively connected to the suction tube 54 is a first squeeze bulb 58 mounted on a connecting tube 60 and a second squeeze bulb 62, the second squeeze bulb 62 being located between the suction tube 54 and the connecting tube 60, on the one hand, and a dispensing tube 64 on the other hand. The sprayer 52 may be formed in any shape which is compatible with its purposes. However, the sprayer 52 is preferentially shaped to resemble an animal's head 66 or other structure which would be entertaining to the infant. If an animal head 66 is used, the outlet end 68 of the dispensing tube 64 is located in or near the mouth 70 of the animal head 66 and the second squeeze bulb 62 is located in a forward surface of the sprayer 52 where it can be operated by the infant depressing the second squeeze bulb 62 with its foot. The first squeeze bulb 58 is located, and the length of the connecting tube 60 is sized, so as to be convenient for use of the person bathing the infant. The outlet end of the dispensing tube 64 may be left open or a spray nozzle 72 may be attached thereto to create a spray rather than a stream of water when the first or second squeeze bulb 58 or 62 is depressed. First, second and third one way check valves 74, 76 and 78 are located in the suction tube 54, connecting tube 60 and dispensing tube 64, respectively, so that a continuous column of water is maintained in the tubes 54, 60 and 64. This assures that pressure placed on either of the first or second squeeze bulbs 58 or 62 results in an immediate ejection of a stream of water from the outlet end 68 of dispensing tube 64.

Figure 5:
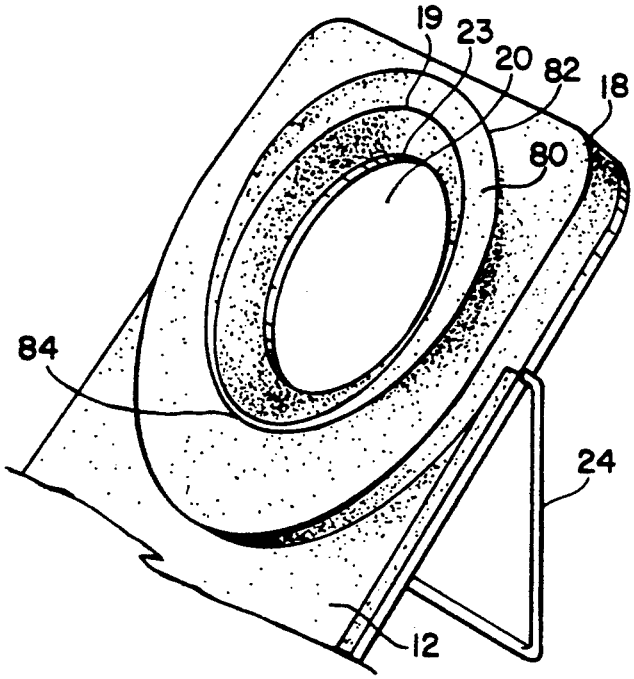
FIG. 5 is an enlarged perspective view of the head portion of a second embodiment of the seat having features of the invention.
Figure 6:
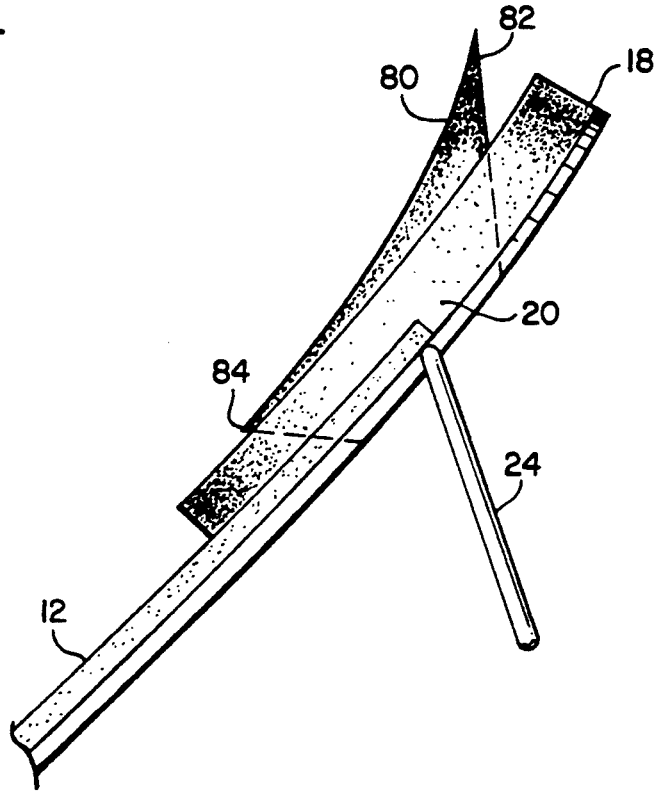
FIG. 6 is an enlarged side view of the head portion of the embodiment of FIG. 5.

FIGS. 5 and 6 show a second embodiment of the head portion of the bathenette 10 embodying features of the invention.

The embodiment includes band 80 attached to the headrest 18 surrounding and continuing the funnel shape of the opening 20. The band 80 may extend a uniform distance from the headrest 18 surface or, as best shown in FIG. 6, the upper edge 82 may extend a greater distance than the lower edge 84. The shorter extension of the lower edge 84 corresponds with the baby's neck when reclining on the baby seat 12. The band 80 aids in retaining the baby's head in the desired position.

In an alternate orientation, the band 80 can be folded down so that the upper edge 82 and lower edge 84 extend into the opening 80, thus, reducing the side of the opening 80 to better support infants with very small heads.

Although the bathenette seat has been described in considerable detail with reference to particular preferred versions, other versions are possible. For example, the tub can be eliminated and the seat can be sized for placement in any existing water containing vessel such as an adult-sized bath tub, a sink or any flat bottom vessel. Also, the shower head 46 and its mounting and/or the sprayer 52 can be eliminated as attachments to the tub or replaced by similar structure mounted to the existing water containing vessel. Therefore, the spirit and scope should not be limited to the description of the preferred versions contained herein.

What is claimed is:

1. A support for using during bathing of a child comprising:

a headrest adapted to support a child's head wherein the headrest has an opening therein dimensioned to receive the back of the child's head such that at least a portion of the periphery of the opening closely proximates the size of the child's head, a leg support spaced from the headrest and a depression formed in said support for supporting the buttock's of the child, the depression located between the leg support and the headrest, and a sprayer located on the leg support, a suction tube connected to the sprayer to draw water into the sprayer from a reservoir located below the support and a squeeze bulb operatively connected to the suction tube to cause water to move from the reservoir through the sprayer and onto the child positioned in the seat.

2. The support of claim 1 wherein the support has a structure depending therefrom, said structure sized to properly position the infant for bathing.

3. The support of claim 2 wherein the structure depending from the support is adjacent to the headrest and comprises a headrest support bar.

4. The support of claim 1 wherein the headrest has an outwardly facing upper surface and the opening in the headrest tapers from a larger diameter to a smaller diameter, the larger diameter being at the upper surface of the headrest.

5. The support of claim 1 wherein the opening in the headrest is surrounded by a soft, foam material.

6. The support of claim 1 which further comprises a band extending outward from the headrest around the opening, the band sized to receive the child's head.

7. A baby seat for holding a baby during bathing procedures comprising:

(a) a leg support portion, a headrest portion, and a depression, the depression being located between the leg support portion and the headrest portion, the depression being located below the leg support portion and the headrest portion being located above the leg support portion, the leg support portion and the headrest portion being located at opposite ends of the seat; and (b) the headrest portion including an opening therein, the headrest portion surrounding the opening being located and sized to support and surround the head of the baby during bathing when the baby is positioned on the seat with its buttocks located in the depression, the baby seat further including means to spray water on the baby when placed on the seat, the spray means being located on the leg support portion.

8. The baby seat of claim 7 further comprising a band extending from the headrest portion, the band surrounding the opening and being sized to support and surround the head of the infant.

9. The baby seat of claim 8 further including a cushioning material applied to the headrest portion and the depression.

10. A bathenette seat comprising:

(a) a tub capable of retaining water; and (b) a seat within the tub adapted to receive and cradle an infant child, the seat including a headrest movably mounted thereto and adapted to support the child's head;

wherein the headrest has an opening therein dimensioned to receive the back of the infant child's head in such a way that at least a portion of the headrest surrounding the opening supports the child's head when the back of the child's head is received within the opening, the headrest including a depending headrest bar to support the headrest in a desired position, the tub has a bottom with a flat exterior surface and a first and a second interior surface, the first and second interior surfaces each sloping upward from a point on the bottom, the first interior surface sloping up to a foot end and the second interior surface sloping up to a head end of the tub, the foot end being spaced from the head end and wherein the second sloped surface includes means for interaction with the headrest bar to assist in adjusting the position of the headrest.

11. The bathenette of claim 10 wherein the seat further comprises a leg support at one end thereof and a depression formed therein for supporting the buttocks of the baby, the depression located between and below the leg support and the headrest.

12. The bathenette of claim 11 which further comprises a sprayer attached to the leg support of the seat.

13. The bathenette of claim 12 wherein the sprayer includes suction means to draw water from the tub for dispersion onto an infant child positioned on the seat.

14. The bathenette of claim 10 further comprising a band attached to and extending above the headrest and surrounding the opening, the band sized to receive the back of the child's head.

15. The bathenette of claim 10 wherein the seat adapted to receive and cradle the infant is covered by a cushioning material.

* * * * *